United States Patent [19]

Brede et al.

[11] Patent Number: 4,674,405

[45] Date of Patent: Jun. 23, 1987

[54] PARTIALLY COMBUSTIBLE PROPELLANT CHARGE IGNITER

[75] Inventors: Uwe Brede, Furth; Alfred Horr, Zirndorf; Heinz Reiss, Furth, all of Fed. Rep. of Germany

[73] Assignee: Dynamit Nobel Aktiengesellschaft, Troisdorf, Fed. Rep. of Germany

[21] Appl. No.: 819,847

[22] Filed: Jan. 17, 1986

[30] Foreign Application Priority Data

Jan. 23, 1985 [DE] Fed. Rep. of Germany ..... 3502166

[51] Int. Cl.[4] ..... F42C 19/08

[52] U.S. Cl. ..... 102/202; 102/380

[58] Field of Search ..... 102/202, 380, 202.5, 102/204, 470, 472

[56] References Cited

U.S. PATENT DOCUMENTS 3,581,662 6/1971 Grebert ..... 102/202

3,899,973 8/1975 Brocart ..... 102/202

4,492,167 1/1985 Brede et al. ..... 102/204

*Primary Examiner*—Charles T. Jordan

*Attorney, Agent, or Firm*—Antonelli, Terry & Wands

[57] ABSTRACT

A partially combustible propellant charge igniter has a bottom piece with primer charge and an ignition gas guide tube adjoining this primer charge, with a combustible tube containing the booster charge, the internal diameter of this latter tube being larger than that of the ignition gas guide tube, and a cavity containing a separating charge between the ignition gas guide tube and the combustible tube. A communicating opening is provided between the propagation charge and the separating charge. The communicating opening comprises at least one bore in a valve bonnet, valve means being provided which, in case of excess pressure in the cavity with respect to the booster charge close the bores at least partially, so that ignition of the separating charge takes place essentially through the bore.

14 Claims, 8 Drawing Figures

PARTIALLY COMBUSTIBLE PROPELLANT CHARGE IGNITER

This invention relates to a partially combustible propellant charge igniter by means of which a base charge can be ignited.

In partially combustible propellant charge primers or igniters, the combustible ignition guide tube must be combusted entirely and must not remain attached to the bottom piece in this process. In order to ensure complete combustion and separation of the propellant charge igniter from the bottom piece, DOS No. 3,226,269 discloses a propellant charge igniter exhibiting a metallic bottom piece comprising a primer charge and an adjoining, centrally located ignition gas guide chamber. A combustible tube is inserted in the bottom piece. A cavity is arranged between the wall of the ignition gas guide chamber and the combustible tube, a separating charge being disposed in this cavity. An annular nozzle is arranged between this chamber and the space where the propagation or booster charge is located; the evolving gases exit through this nozzle after ignition of the separating charge. On account of this efflux, the combustible tube is weakened by erosion to such an extent that perfect combustion and, respectively, separation at the severing point are ensured.

In the disclosed device, the annular nozzle is utilized not only as an efflux aperture for the combustion gases of the separating charge, but also for the ignition of the separating charge by the initial influx of hot combustion gases of the propagation charge. The nozzle thus must basically exhibit a certain orifice before and after the ignition gases flow into the cavity with the separating charge. In this separating mechanism, blockage of the annular nozzle by the high gas velocity of the separating charge gases is utilized in the procedure. In the initial phase of combustion, this blockage is to have the effect that the nozzle remains closed to a more or less defined extent until the primary pressure becomes so high that the erosion effect for separating the combustible tube commences. Such self-action blocking mechanisms, however, are dependent on the temperature, as is known. Moreover, even the reaction velocity of the separating charge is dependent on the temperature and, accordingly, produces an additional scattering in the progression of the function during the separating step in the conventional device.

It is an object of the present invention to further develop a device according to the state of the art so that the separating step takes place in a more accurately defined fashion and, thus, in a better reproducible way.

This object has been attained in the device of this invention, which comprises a bottom piece with an igniter or primer charge, an ignition gas guide tube adjoining the primer charge, a combustible tube containing a booster charge, the internal diameter of the combustible tube being larger than that of the ignition gas guide tube, a cavity between the guide tube and the combustible tube, said cavity containing a separating charge and a communicating opening between the booster charge and the separating charge, by further providing that the communicating opening between the booster charge and the cavity of the separating charge comprises at least one bore in a valve bonnet, which bonnet is equipped with valve means that closes, in case of excess pressure in the cavity with respect to the propagation charge, the at least one bore at least temporarily; the ignition of the separating charge taking place essentially through at least one bore.

On account of this arrangement, the ignition conditions are kept constant, as is necessary for initiating the combustion of the separating charge. After onset of the reaction of the booster charge and the accompanying influx of the ignition gases into the charge chamber of the separating charge, the charge chamber of the separating charge is sealed at an early point in time by the valve means.

Preferably, the valve bonnet is inserted in an essentially flush manner in the partially combustible tube exhibiting a certain inherent elasticity. This ensures that, after closing of the valve means, the charge chamber of the separating charge is initially completely sealed, so that the initial conditions for ignition of the separating charge can be set quite exactly. Once the primary reaction of the burning separating charge has commenced, the pressure rises to such an extent that the combustible tube will readily yield and an annular nozzle is formed between the valve bonnet and the combustible tube; the hot combustion gases can then flow through this annular nozzle and effect separation.

Additional preferred embodiments can be seen from the following description and the practical embodiments described hereinafter. In order to clarify the object of the present invention, a preferred embodiment of the invention is described by way of example hereinbelow with reference to the figures in the drawings wherein.

Figure 1:
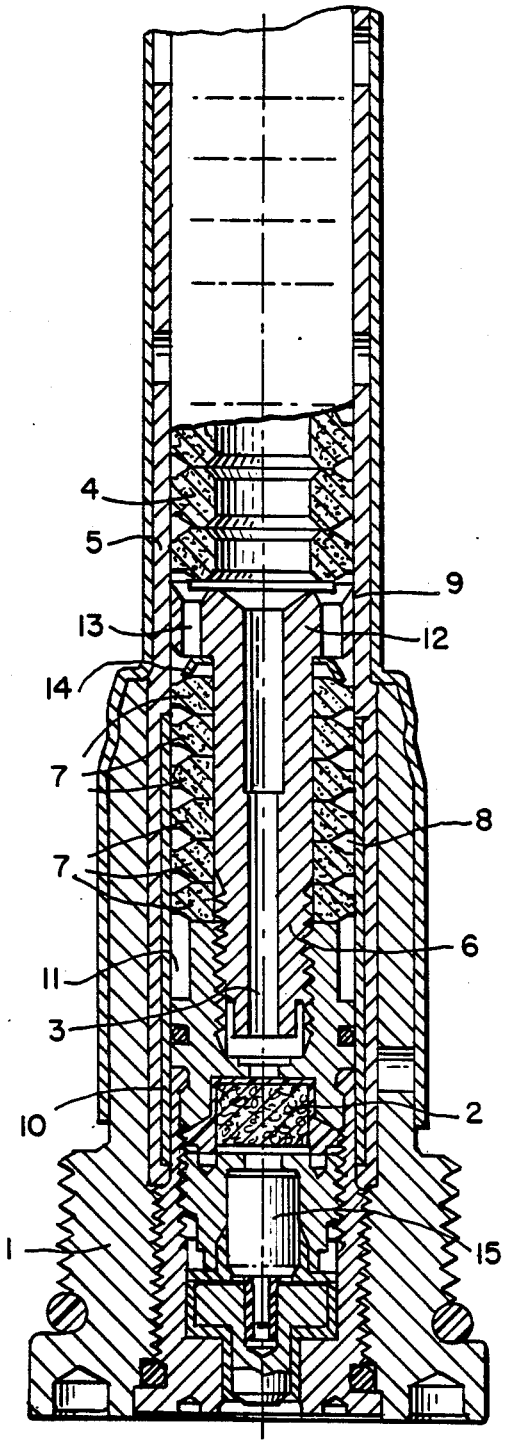
FIG. 1 shows a partial longitudinal section through an ignition component designed in accordance with a preferred embodiment of the invention.

As shown in FIG. 1, a combustible tube 5 is inserted into a bottom piece 1. Coaxially thereto, an ignition guide tube 6 with internally located ignition gas guide chamber 3 is arranged in such a way that the combustion gases of a primer or igniter charge 2 can flow therethrough after ignition by means of a primary igniter element 15. At its end opposed to the bottom piece, the ignition guide tube has a valve bonnet 12 seated in the combustible tube in an essentially flush manner.

The column of tablets of the propagation charge 4 is located in the combustible tube 5 on the valve bonnet and/or adjoining the bonnet. A separating charge 7 (consisting of annular tablets or pellets) is located in the cavity formed between the ignition guide tube 6 and the combustible tube 5 and/or between the valve bonnet 12 and the bottom piece 1. A valve disk 14 is inserted between the separating charge 7 and the valve bonnet 12.

Figure 2:
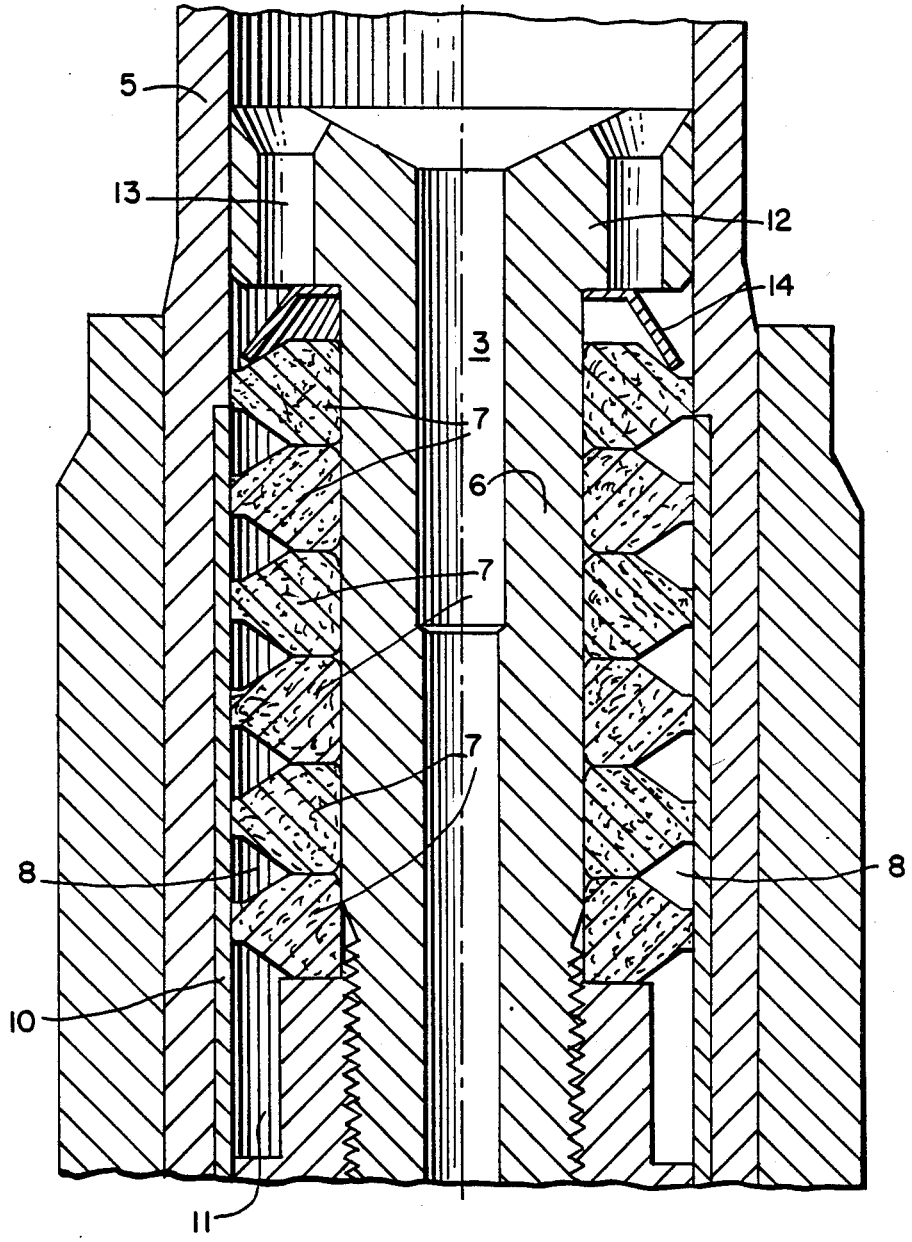
FIG. 2 shows an enlarged representation of the valve bonnet with valve means and a separating charge according to FIG. 1.

As can be seen in greater detail from FIG. 2, bores 13 are arranged in the valve bonnet 12. The valve disk 14 has an essentially planar portion 14*b* seated on the end of the valve bonnet 12 facing the bottom piece 1. An angled portion 14*a* adjoins the planar portion 14*b;* this angled portion extends into the hollow space 8,11 between the ignition guide tube 6 and the combustible tube 5. The column of pellets 7 is dimensioned in its length so that it is resiliently supported by the valve disk 14. The interruption or transition point between the planar portion 14*b* of the valve disk 14 and the angled portion 14*a* lies in the zone of the bore 13, in the embodiment of the invention illustrated herein.

Figure 3:
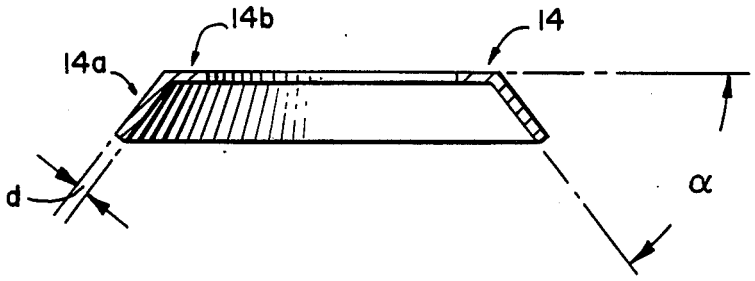
FIG. 3 is a longitudinal section through a preferred embodiment of a valve disk.

As shown in greater detail in FIG. 3, the valve disk 14 exhibits a central bore in the planar portion 14*b*, through which the ignition guide tube 6 extends. The portion 14*a* of the valve disk 14 is flanged downwardly with respect to the planar portion 14*b* by an angle $\alpha$, the dimensioning of which is included in the closing characteristic of these valve means. The thickness d of the disk, as well as the material of which it is made, form the further parameters for determining this closing characteristic. The valve disk 14 is preferably made of steel (ST 4 LG DIN 1624) and has a thickness d of between 0.1 and 0.5 mm. With the use of such a material, the conical angle $\alpha$ of the valve disk is preferably between about 50° and 60°. It is, of course, also possible in correspondence with the selected material and the chosen thickness of the material to mount a valve disk that exhibits a narrower planar region 14*b*, or that fails to exhibit such a region and consisting merely of a conical part 14*a*.

Figure 4:
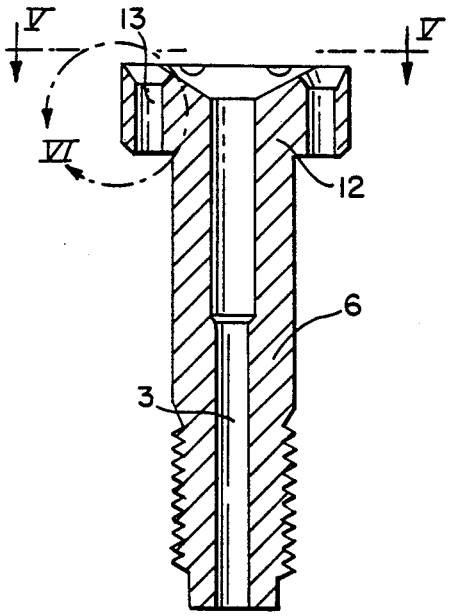
FIG. 4 shows a longitudinal section through an embodiment of the ignition guide tube with a valve bonnet along line IV—IV of FIG. 5.
Figure 5:
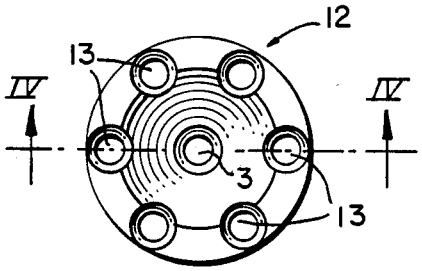
FIG. 5 shows a top view of a valve bonnet according to FIG. 4 along line V—V.
Figure 6A:
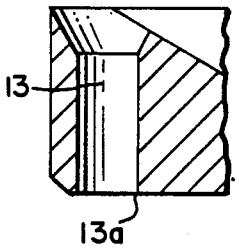
FIGS. 6*a* through 6*c* show enlarged fragmentary views, in section, of the zone VI according to FIG. 4 illustrating the valve bores.
Figure 6B:
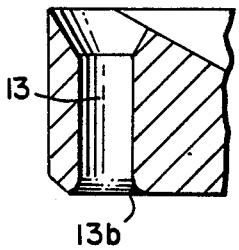
Figure 6C:
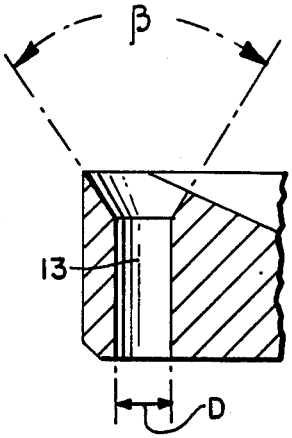

The valve bonnet 12 shown in FIGS. 4 and 5 adjoining the ignition guide tube 6 (preferably the bonnet is integrally formed with the guide tube for the sake of a simpler manufacture) exhibits all around the central bore of the ignition gas guide chamber 3 several bores 13 distributed equidistantly over the circumference. As is described in greater detail in FIG. 6, the bores 13 exhibit, on their sides facing the propagation charge 4, conically indented influx angles $\beta$ which facilitate influx of the ignition gases of the booster charge to the separating charge 7. This influx angle ranges preferably from 50° to 70°.

In order to be able to adjust the pressure curve in the cavity 8,11 over the time essentially arbitrarily, the edges 13*a* of the bores 13 facing the separating charge 7 are fashioned to be sharp in a preferred embodiment. If then the pressure in space 8,11 rises after the valve disk 14 has been seated (closing of the valve means), the valve disk 14 is punched off at the edge 13*a* and thus again vacates the bore 13. It is possible in this manner to obtain pressure relief in the cavity 8,11, which defines and/or reduces the entire mechanical stress on the building components of the separating mechanism. If this pressure relief is to take place successively over a relatively long time period, then preferably the bores 13 are made to be of varying diameters so that one after the other is vacated.

In another preferred embodiment (FIG. 6*b*), the bores 13 are rounded or chamfered at their ends 13*b* facing the separating charge 7, so that the valve disk 14 is not punched off but rather pulled through the bore 13. A combination of the two possibilities (FIG. 6*a*, FIG. 6*b*) results in an even more uniform pressure curve. Of course, the thickness d of the valve disk 14, as well as its material properties, are also included herein as essential, determining parameters.

The mode of operation of the embodiment of a partially combustible propellant charge igniter illustrated herein will be described in greater detail below.

After electric ignition of the primary primer element 15 in the bottom piece 1, the primer charge 2 is ignited. The thus-formed ignition flame is conducted through the ignition gas guide chamber 3 in the ignition guide tube 6 to the pellet column of the propagation charge 4 which charge is thereby ignited. The combustion gases of the propagation charge 4 flow back through the bores 13 in the valve head 12, namely, into the cavity 8,11 where the annular tablets 7 of the separating charge are located. Upon ignition of the separating charge 7, the pressure rises in the interior of the cavity 8,11. In this connection, the charge density of the separating charge is dimensioned so that it is in any event higher than the charge density in the propellant charge igniter proper. As soon as the pressure in the cavity 8,11 has reached a certain level, the upwardly curved portion 14*a* of the valve disk 14 is pushed outwardly; it is placed on the lower rim of the valve bonnet 12 and thus seals the bores 13. Consequently, the bores 13 in the initial phase serve exclusively for igniting the separating charge 7. If the pressure in the cavity then rises, after the automatic sealing of the cavity 8,11 of the separating charge 7 by the progressive combustion of the separating charge, then the internal pressure loads, on account of the elasticity of the combustible tube 5, to a lifting off or separating of the tube 5 from contact with the valve bonnet 12. Therefore, an annular nozzle is formed between the two parts, through which the hot combustion gases of the separating charge 7 flow. Due to this defined flow, then, the combustible tube 5 is eroded so that complete combustion and/or severing of this tube occurs. In order to avoid afterglow, the space 8,11 of the separating charge 7 is preferably shielded from the combustible tube 5 by a metallic wall 10.

Since the flow through the nozzle formed between the valve bonnet 12 and the combustible tube 5 is to proceed with maximum uniformity, the differential pressure between the cavity 8,11 and the space occupied by the booster charge 4 must remain maximally constant. This is achieved by the feature that, in case of an excess rise of the pressure in the cavity 8,11, the valve disk 14, as described above, is punched out at the bores 13 or is pulled therethrough. Thereby, relief orifices are produced which effectively decrease the pressure in the cavity 8,11 without substantially modifying the separating action of the gases flowing through the annular nozzle between the valve bonnet 12 and the tube 5. Consequently, by means of the arrangement illustrated herein, an optimum pressure curve is achieved in correspondence with the material and/or combustion properties, ensuring a reproducible function even if varying environmental conditions (e.g., ambient temperature) evoke fluctuation in the combustion curves.

What is claimed is:

1. A partially combustible propellant charge igniter having a bottom piece with a primer charge, an ignition gas guide tube adjoining said primer charge, a combustible tube containing a booster charge, the internal diameter of said combustible tube being larger than that of the ignition gas guide tube, a cavity formed between the ignition gas guide tube and the combustible tube, said cavity containing a separating charge, and a communicating opening located between the booster charge and the separating charge, the communicating opening between the booster charge and the cavity of the separating charge comprising at least one bore in a valve bonnet, said bonnet including valve means for sealing the at least one bore at least temporarily in case of excess pressure in the cavity with respect to the booster charge and the ignition of the separating charge taking place essentially through the at least one bore.

2. A propellant charge igniter according to claim 1, wherein the valve bonnet is inserted essentially flush in the combustible tube and the combustible tube exhibits an inherent elasticity.

3. A propellant charge igniter according to claim 1, wherein the valve means is fashioned so that, after sealing the at least one bore, the valve means again vacates the bore at least partially in case of a defined excess pressure in the cavity.

4. A propellant charge igniter according to claim 1, wherein the valve means comprises an annular valve disk lying underneath the valve bonnet in the cavity, a rim of said valve disk being bent up with respect to a support surface, and the at least one bore being so arranged that the at least one bore is covered by the rim after deformation of the valve disk into an essentially planar disk which takes place during deflagration of the separating charge.

5. A propellant charge igniter according to claim 1, wherein several bores are arranged in an essentially equidistant pattern in the valve bonnet.

6. A propellant charge igniter according to claim 5, wherein the bores exhibit differing diameters.

7. A propellant charge igniter according to claim 4, wherein the valve disk consists of a metallic material.

8. A propellant charge igniter according to claim 7, wherein the valve disk has a material thickness in the range from 0.1 to 0.5 mm.

9. A propellant charge igniter according to claim 7, wherein an angle ($\alpha$) about which the valve disk is bent amounts to between 50° and 60°.

10. A propellant charge igniter according to claim 4, wherein said bore exhibits, on the side of the cavity, a sharp terminal edge providing a punching effect.

11. A propellant charge igniter according to claim 4, wherein said bore exhibits, on the side of the cavity, a deburred terminal edge for the gradual pulling through of the valve disk.

12. A propellant charge igniter according to claim 1, wherein each bore exhibits a diameter of 1–5 mm.

13. A propellant charge igniter according to claim 1, wherein each bore exhibits an influx angle ($\beta$) on its sides facing the booster charge.

14. A propellant charge igniter according to claim 13, wherein the influx angle ($\beta$) is between 50° and 70°.

* * * * *